US006345398B1

(12) United States Patent
Maxson

(10) Patent No.: US 6,345,398 B1
(45) Date of Patent: Feb. 12, 2002

(54) DRAIN PLUG WITH A CENTRAL DRAINAGE APERTURE FOR A BATHTUB

(76) Inventor: Samuel Maxson, 17804 W. Chelsea Way, Apt. 205, Canyon Country, CA (US) 91351

( * ) Notice: Subject to any disclaimer, the term of this patent is extended or adjusted under 35 U.S.C. 154(b) by 0 days.

(21) Appl. No.: 09/780,331

(22) Filed: Feb. 9, 2001

(51) Int. Cl.[7] ..... F03C 1/22
(52) U.S. Cl. ..... 4/680; 4/654; 141/340
(58) Field of Search ..... 4/680, 658; 141/331, 141/339–342

(56) References Cited

U.S. PATENT DOCUMENTS

,757,871 A * 4/1904 Akers et al. ..... 4/680
904,539 A * 11/1908 Koenig ..... 4/680 X
2,065,347 A * 12/1936 Schulse ..... 4/654
2,560,954 A * 7/1951 Jackson ..... 4/680
4,077,430 A * 3/1978 Brown et al. ..... 4/680 X
4,106,133 A * 8/1978 Roberts ..... 4/680 X
4,205,710 A * 6/1980 Dunicz ..... 141/9
4,648,140 A * 3/1987 Bogusz ..... 4/654
5,452,484 A * 9/1995 Hill ..... 4/658

* cited by examiner

*Primary Examiner*—Charles E. Phillips
(74) *Attorney, Agent, or Firm*—Goldstein Law Offices, P.C.

(57) ABSTRACT

A drain plug with a central drainage aperture for a bath tub including a plug insert dimensioned for positioning within the water drain of the bath tub. The plug insert has an conduit extending between its wide upper end and the narrow lower end. A plug cover is provided that is dimensioned for covering the water drain of the bath tub around the plug insert. The plug cover is integral with the plug insert.

3 Claims, 2 Drawing Sheets

Fig. 1
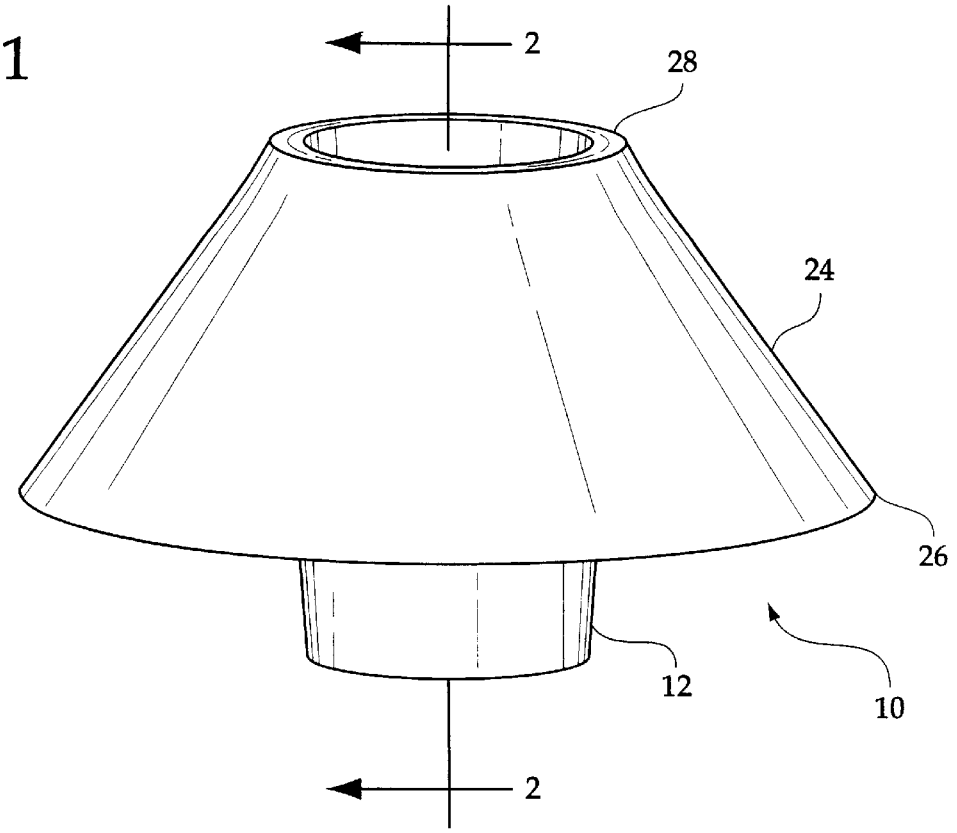
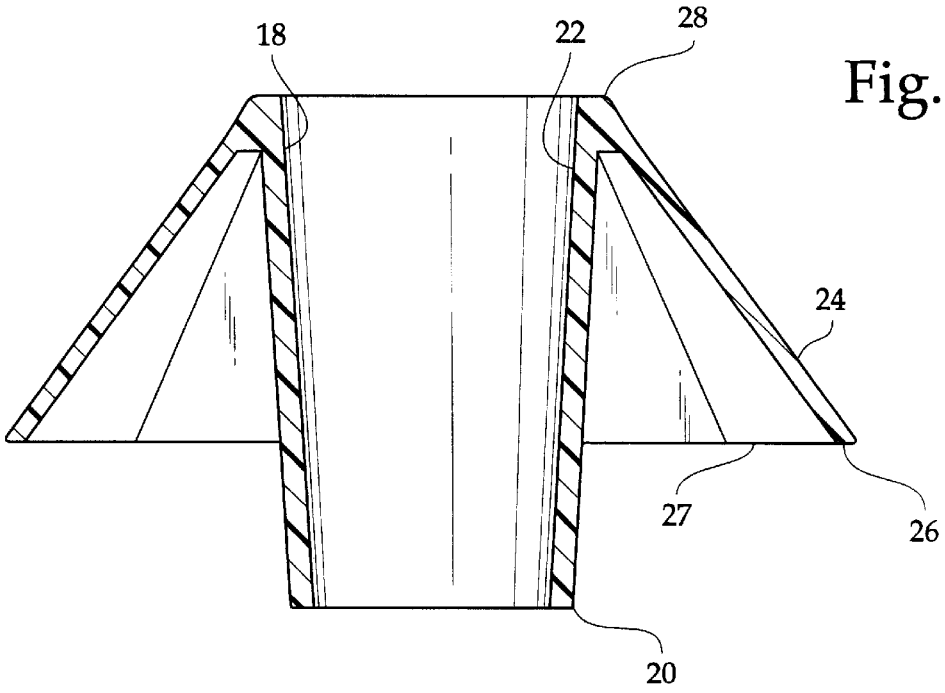
Fig. 2

DRAIN PLUG WITH A CENTRAL DRAINAGE APERTURE FOR A BATHTUB

CROSS REFERENCES AND RELATED SUBJECT MATTER

This application relates to subject matter contained in patent application Ser. No. 09/439,252, filed in the United States Patent Office on Nov. 12, 1999 now abandoned.

BACKGROUND OF THE INVENTION

The present invention relates to a drain plug with a central drainage aperture for a bath tub and more particularly pertains to maintaining a consistent water level in a bath tub.

Conventional drain plugs are used to arbitrarily maintain a water level in a bath tub. That is, when the plug is in place, water will not enter the drain. Accordingly, the water level will be maintained, as long as no additional water is added to the tub. However, by preventing water from entering the drain, the typical drain plug does nothing to prevent water from reaching unsuitable levels, where property damage, or danger to individuals can occur.

The use of drain plugs for bath tubs is known in the prior art. More specifically, drain plugs for bath tubs heretofore devised and utilized for the purpose of preventing water from draining out of a bath tub are known to consist basically of familiar, expected and obvious structural configurations, notwithstanding the myriad of designs encompassed by the crowded prior art which have been developed for the fulfillment of countless objectives and requirements.

While these devices fulfill their respective, particular objective and requirements, these patents do not describe a drain plug with a central drainage aperture for a bath tub for maintaining a consistent water level in a bath tub.

In this respect, the drain plug with a central drainage aperture for a bath tub according to the present invention substantially departs from the conventional concepts and designs of the prior art, and in doing so provides an apparatus primarily developed for the purpose of maintaining a consistent water level in a bath tub.

Therefore, it can be appreciated that there exists a continuing need for a new and improved drain plug with a central drainage aperture for a bath tub which can be used for maintaining a consistent water level in a bath tub. In this regard, the present invention substantially fulfills this need.

SUMMARY OF THE INVENTION

In the view of the foregoing disadvantages inherent in the known types of drain plugs for bath tubs now present in the prior art, the present invention provides an improved drain plug with a central drainage aperture for a bath tub. As such, the general purpose of the present invention, which will be described subsequently in greater detail, is to provide a new and improved drain plug with a central drainage aperture for a bath tub which has all the advantages of the prior art and none of the disadvantages.

To attain this, the present invention essentially comprises a plug insert dimensioned for positioning within the water drain of the bath tub. The plug insert has a generally tapered cylindrical configuration. The plug insert has a wide upper end and a narrow lower end. Accordingly, the narrow lower end can be inserted into the wide upper end of another plug insert, allowing the plug inserts to be stacked so as to maintain a higher water level. The plug insert has an opening extending downwardly through the wide upper end and the narrow lower end. A plug cover is provided that is dimensioned for covering the water drain of the bath tub. The plug cover has a generally frustoconical configuration defined by a wide lower end and a narrow upper end. The plug cover has an opening extending downwardly through the narrow upper end and the wide lower end. The wide lower end is integral with the wide upper end of the plug insert whereby the opening of the plug cover is linearly aligned with the opening of the plug insert.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved drain plug with a central drainage aperture for a bath tub which has all the advantages of the prior art drain plugs for bath tubs and none of the disadvantages, such that an equilibrium water level is obtained, wherein water may be added to the tub while said equilibrium water level is substantially maintained.

It is another object of the invention to provide a drain plug which is "stackable" with other similar drain plugs. Accordingly, more than one drain plug can be used to customize the equilibrium water level within the tub.

It is another object of the present invention to provide a new and improved drain plug with a central drainage aperture for a bath tub which may be easily and efficiently manufactured and marketed.

It is a further object of the present invention to provide a new and improved drain plug with a central drainage aperture for a bath tub which is of durable and reliable construction.

An even further object of the present invention is to provide a new and improved drain plug with a central drainage aperture for a bath tub which is susceptible of a low cost of manufacture with regard to both materials and labor, and which accordingly is then susceptible of low prices of sale to the consuming public, thereby making such a drain plug with a central drainage aperture for a bath tub economically available to the buying public.

Even still another object of the present invention is to provide a new and improved drain plug with a central drainage aperture for a bath tub for maintaining a consistent water level in a bath tub.

Lastly, it is an object of the present invention to provide a new and improved drain plug with a central drainage aperture for a bath tub including a plug insert dimensioned for positioning within the water drain of the bath tub. The plug insert has an opening extending downwardly therethrough the wide upper end and the narrow lower end. A plug cover is provided that is dimensioned for covering the water drain of the bath tub. The plug cover has an opening extending downwardly therethrough the narrow upper end and the wide upper lower end. The plug cover is integral with the plug insert whereby the opening of the plug cover is linearly aligned with the opening of the plug insert.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the drain plug with a central drainage aperture for a bath tub constructed in accordance with the principles of the present invention.

FIG. 2 is a cross-sectional view of the present invention as taken along line 2—2 of FIG. 1.

The same reference numerals refer to the same parts through the various figures.

DESCRIPTION OF THE PREFERRED EMBODIMENT

Figure 3:
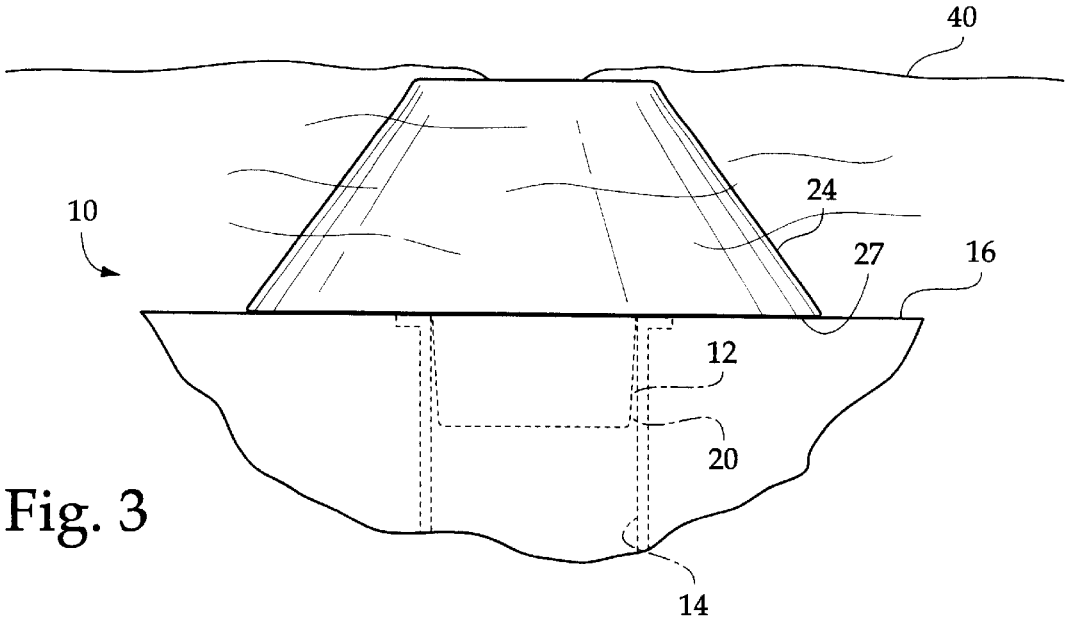
FIG. 3 is a side elevational view of the present invention illustrated in use, mounted within a drain.

With reference now to the drawings, and in particular, to FIGS. 1 through 4 thereof, the preferred embodiment of the new and improved drain plug with a central drainage aperture for a bath tub embodying the principles and concepts of the present invention and generally designated by the reference number 10 will be described.

Specifically, it will be noted in the various Figures that the device relates to a drain plug with a central drainage aperture for a bath tub which maintains a consistent water level in a bath tub. In its broadest context, the device comprises of a plug insert and a plug cover. Such components are individually configured and correlated with respect to each other so as to attain the desired objective.

The plug insert 12 is dimensioned for positioning within the water drain 14 of the bath tub 16. The plug insert 12 has two open ends, and a generally tapered cylindrical configuration therebetween. The plug insert 12 has a wide upper end 18 and a narrow lower end 20. The plug insert 12 has a conduit 22 extending downwardly from the wide upper end 18 to the narrow lower end 20.

The plug cover 24 is dimensioned for covering the water drain 14 of the bath tub 16. Accordingly, the plug cover 24 prevents leakage into the drain 14 by shrouding the plug insert. The plug cover 24 has a generally frustoconical configuration defined by a wide lower end 26 and a narrow upper end 28. The plug insert 12 and conduit 22 therein extends downwardly through the narrow upper end 28 and the wide lower end 26 which has a flat lower surface 27 such that the plug cover 24 creates a flange from the plug insert 12. The narrow upper end 28 of the plug cover 24 is integral with the wide upper end 18 of the plug insert 12. In the preferred embodiment, the narrow upper end 28 of plug cover 24 is elevated about two inches above the water drain 14 of the bath tub 16 by virtue of a two inch distance between the flat surface 27 at the wide lower end 26 and narrow upper end 28 of the plug cover 24. Note FIG. 2. The elevation of the plug cover 24 with respect to the water drain 14 can vary according to the desires of the user.

In use, the present invention mounts within the drain 14, with its flat lower surface 27 against the bath tub 16, preventing water from entering the drain, unless the water is above the upper end 28. The narrow lower end 20 of the plug insert 12 extends beyond the flat lower surface 27 so as to effectively communicate water into the drain 14. Accordingly, the drain plug 10 maintains a consistent water level in the bath tub 16 because any water that rises above the height of the narrow upper end 28 of the plug cover 24 will drain through the conduit 30 extending therefrom. Accordingly, a user can add water to the bath tub, replenishing cool water with hot water, or dirty water with clean water, while maintaining a safe equilibrium water level 40.

Figure 4:
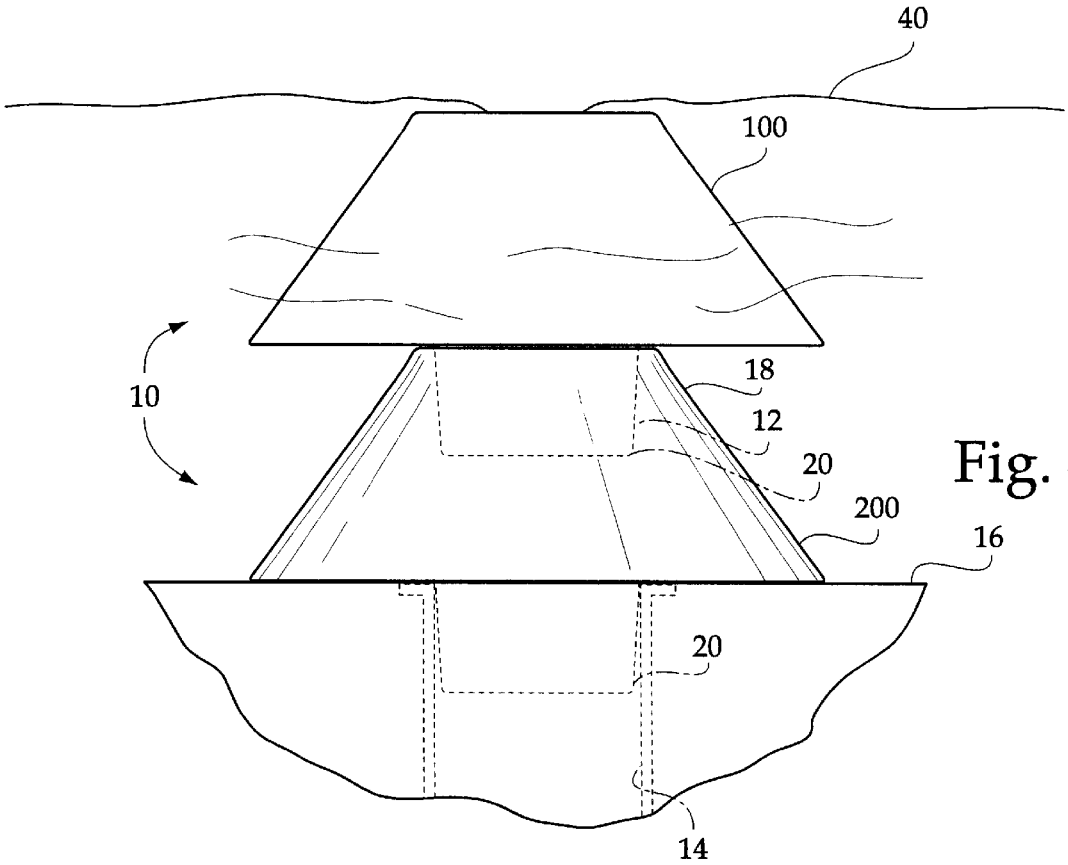
FIG. 4 is a cross-sectional side view of the present invention illustrated in use, wherein two drain plugs are stacked to achieve a higher equilibrium water level.

In addition, referring to FIG. 4, the plug insert 12 is made so that the narrow lower end 20 of the plug insert 12 is sized to fit snugly within the wide upper end 18 of an identical plug insert 12. Accordingly, two or more drain plugs may be combined by inserting the narrow lower end 20 of a first drain plug 100 into the wide upper end 18 of a second drain plug 200, and then inserting the narrow lower end 20 of the second drain plug 200 in the drain 14. When the drain plugs 100 and 200 are so combined, the effective equilibrium water level 40 is raised. In that respect, the plug inserts 12 are preferably made of a rubberized material, to facilitate a water-tight fit between plug inserts 12 in this manner.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A drain plug with a central drainage aperture for a bath tub having a water drain for maintaining a consistent water level in a bath tub comprising, in combination:

a plug insert dimensioned for positioning within the water drain of the bath tub, the plug insert having a generally tapered cylindrical configuration, the plug insert having a wide upper end and a narrow lower end, the plug insert having an conduit extending downwardly between the wide upper end and the narrow lower end, the narrow lower end sized so that it could fit within the wide upper end of an identical plug insert to allow stackability of the drain plugs;

a plug cover dimensioned for covering the water drain of the bath tub, the plug cover having a generally frusto-conical configuration defined by a wide lower end and a narrow upper end, the wide lower end forming a flat lower surface which flanges outward from the plug insert, wherein the lower end of the plug insert extends beyond the flat lower surface.

2. The drain plug with a central drainage aperture as set forth in claim 1, wherein the narrow upper end of the plug cover is elevated about two inches above the flat lower surface of the plug cover.

3. A drain plug with a central drainage aperture for a bath tub having a water drain for maintaining a consistent water level in a bath tub comprising, in combination:

a plug insert dimensioned for positioning within the water drain of the bath tub, the plug insert having two open ends, the plug insert tapered therebetween, having a wide upper end and a narrow lower end, with a conduit extending therebetween, such that the narrow lower end is sized to fit within the wide upper end of an identical plug insert, to allow stackability of the drain plugs;

a plug cover dimensioned for covering the water drain of the bath tub wherein the plug cover has a flat lower surface which rests against the tub around the drain, the lower end of the plug insert extending beyond the flat lower surface, the plug cover having an opening extending downwardly therethrough, the plug cover being integral with the plug insert whereby the opening of the plug cover is linearly aligned with the opening of the plug insert.

* * * * *